US010961009B2

(12) United States Patent
Tanaka et al.

(10) Patent No.: US 10,961,009 B2
(45) Date of Patent: Mar. 30, 2021

(54) THREADED METAL CONTAINER

(71) Applicant: TAKEUCHI PRESS INDUSTRIES CO., LTD., Toyama (JP)

(72) Inventors: Masanori Tanaka, Toyama (JP); Osamu Kume, Toyama (JP); Tetsuya Hama, Toyama (JP)

(73) Assignee: TAKEUCHI PRESS INDUSTRIES CO., LTD., Toyama (JP)

( * ) Notice: Subject to any disclaimer, the term of this patent is extended or adjusted under 35 U.S.C. 154(b) by 288 days.

(21) Appl. No.: 16/088,541

(22) PCT Filed: Oct. 4, 2016

(86) PCT No.: PCT/JP2016/079429
§ 371 (c)(1),
(2) Date: Sep. 26, 2018

(87) PCT Pub. No.: WO2017/168794
PCT Pub. Date: Oct. 5, 2017

(65) Prior Publication Data

US 2019/0106237 A1 Apr. 11, 2019

(30) Foreign Application Priority Data

Apr. 1, 2016 (JP) ..... JP2016-074630

(51) Int. Cl.
*B65D 1/02* (2006.01)
*B65D 1/42* (2006.01)

(52) U.S. Cl.
CPC ..... *B65D 1/0246* (2013.01); *B65D 1/02* (2013.01); *B65D 1/0223* (2013.01); *B65D 1/42* (2013.01)

(58) Field of Classification Search
CPC .... B65D 1/0223; B65D 1/0246; B65D 1/023; B65D 1/42; B65D 1/46; B65D 7/04;
(Continued)

(56) References Cited

U.S. PATENT DOCUMENTS

2005/0115294 A1* 6/2005 Kanou ..... B65D 1/0223 72/121

FOREIGN PATENT DOCUMENTS

CN 202156595 3/2012
CN 202912039 5/2013
(Continued)

OTHER PUBLICATIONS

Office action dated Aug. 5, 2019, in corresponding Chinese application No. 2016800839451.

*Primary Examiner* — Andrew T Kirsch
(74) *Attorney, Agent, or Firm* — Browdy and Neimark, PLLC

(57) ABSTRACT

A threaded metal container capable of improving strength (neck portion transverse rigidity) in a direction perpendicular to a container axis at a neck portion composed of a mouth portion and a shoulder portion. The container includes a body portion, a shoulder portion, and a mouth portion. The mouth portion includes a base portion connected to an upper end of the shoulder portion, and a skirt valley portion, a skirt portion, and a threaded portion, which are above the base portion. The base portion 8 includes a protruding portion protruding radially outward and has a diameter gradually increasing downward from the skirt valley portion and a bead portion radially inwardly protruding and smoothly curving downward from the protruding portion. The bead portion circumferentially extends in a linear or dotted pattern. The bead height between the protruding portion and the bead portion in the direction perpendicular to the container axis is 0.1 to 0.6 mm.

4 Claims, 5 Drawing Sheets

(58) Field of Classification Search
CPC . B65D 7/045; B65D 7/42; B65D 7/44; B65D 7/46; B65D 7/48
See application file for complete search history.

(56) References Cited

FOREIGN PATENT DOCUMENTS

| | | | |
|---|---|---|---|
| JP | 59115239 | A | 7/1984 |
| JP | 2003165539 | A | 6/2003 |
| JP | 3561796 | B2 | 9/2004 |
| JP | 2005096843 | A | 4/2005 |
| JP | 2006176183 | A | 7/2006 |
| JP | 2008087071 | A | 4/2008 |
| WO | 20100117009 | A1 | 10/2010 |

* cited by examiner

THREADED METAL CONTAINER

FIELD OF THE INVENTION

The present invention relates to a threaded metal container of a type in which a mouth portion of a metal container is provided with a threaded portion and a threaded cap is screwed to the threaded portion to thereby seal the mouth portion. More specifically, the present invention relates to a threaded metal container in which strength of a neck portion composed of a mouth portion and a shoulder portion is improved to prevent deformation of the neck portion when capping in a state in which contents are filled in the container.

BACKGROUND ART

FIG. 9 is a partial front view showing the vicinity of a mouth portion of a beverage can which is a conventional threaded metal container, and FIG. 10 is a partial cross-sectional view showing the capping process. The threaded metal can 51 has a two-piece type and a three-piece type, and each can is formed into a bottle shape through a specific manufacturing process (not shown). That is, in the case of a two-piece can, an aluminum plate is formed into a bottomed cylindrical body, and the upper end opening portion of the cylindrical body is necked to reduce the diameter. With this diameter reduction, a shoulder portion 53 inwardly inclined with respect to the container axis is formed, and a cylindrical mouth portion 54 is formed at a portion above the upper end 53*a* of the shoulder portion 53. Further, a cylindrical body portion 52 is formed below the shoulder portion 53. Then, by forming a threaded portion 55, a skirt portion 56, and a skirt valley portion 56*a* smaller in diameter than the skirt portion at the mouth portion 54 and further forming a curled portion 57 at the upper end of the mouth portion 54, a threaded metal can 51 is produced. Also, in the case of a three-piece can (not shown), the bottom portion of the cylindrical body is drawn to reduce the diameter. With this diameter reduction, a shoulder portion 53 inwardly inclined with respect to the container axis and a bottomed mouth portion 54 are formed on the bottom portion side of the cylindrical body, and a body portion 52 is formed on the opening portion side of the cylindrical body. Then, the upper end of the bottomed mouth portion 54 is cut to open. A threaded portion 55, a skirt portion 56, and a skirt valley portion 56*a* smaller in diameter than the skirt portion are formed at the mouth portion 54. The upper end of the mouth portion 54 is formed into a curled portion 57. By joining a bottom cover (not shown) to the lower end opening portion of the body portion 52, a threaded metal can 51 is produced. Note that a base portion 58 larger in diameter than the skirt valley portion 56*a* is formed below the skirt valley portion 56*a* in these two-piece can and three-piece can. The region from the base portion 58 to the curled portion 57 of the upper end forms the mouth portion 54, and the base portion 58 is connected to the upper end 53*a* of the shoulder portion 53.

After filling contents in such a threaded metal can 51, the mouth portion 54 is sealed with a metal cap 60 by a capping process shown in FIG. 10. That is, a cylindrical cap 60 is put on the mouth portion 54 and a load is applied to the can 51 in the axial direction with a pressure block 61. Then, in a state in which the contents are sealed with the cap 60 to which this axial load is being applied, from the side of the cap 60, a thread forming roller 62 is pressed along the threaded portion 55 of the can 51, and a hem bending roller 63 is pressed along the area from the skirt portion 56 to the skirt valley portion 56*a* of the can 51. With this, on the side wall of the cap 60, a female threaded portion 60*a* is formed. At the lower end of the side wall, a fastened portion 60*b* is formed along the step 56*b* between the skirt portion 56 and the skirt valley portion 56*a*. The sealed state of the contents is maintained until the cap 60 is unscrewed and opened. As described above, in the production process of the threaded metal can 51, when forming the female threaded portion 60*a* and the fastened portion 60*b* on the cap 60, a load is applied to the can 51 in the container axis direction with the pressure block 61, and loads are applied to the can 51 in a direction perpendicular to the container axis with the thread forming roller 62 and the hem bending roller 63.

Recently, in order to reduce the production cost of the can, there is a strong demand for thinning the thickness of the material of the can in order to reduce the amount of materials used. However, thinning the material causes a reduction of the overall strength of the threaded metal can. Particularly, since the hem bending roller 63 is directly pressed against the skirt valley portion 56*a*, the load applied in a direction perpendicular to the container axis causes local deformation in the neck portion composed of the mouth portion 54 and the shoulder portion 53. This local deformation is likely to occur in a can in which the outer diameter of the mouth portion is 30 mm or more, especially in a wide mouth can in which the outer diameter of the mouth portion is 35 mm or more, and that the (mouth diameter/body diameter) ratio of the outer diameter of the mouth portion to the outer diameter of the body portion is 0.5 or more, especially 0.6 or more. Therefore, especially in cases where the mouth portion is wide, since it is necessary to prevent deformation during the capping process, there was a limit to thinning of the thickness of the threaded metal can, and therefore the amount of the material used could not be reduced.

Patent Document 1 discloses a threaded metal can aimed at improving radial and axial strength of a threaded portion lower end and a shoulder portion upper end in which a single concave portion smoothly curved inward and/or a single convex portion smoothly curved outward are formed around a tapered shoulder portion upper end radially expanding from the mouth portion lower end.

PRIOR ART DOCUMENT

Patent Document

Patent Document 1: Japanese Patent No. 3561796

SUMMARY OF THE INVENTION

Problems to be Solved by the Invention

However, in this prior art, although its intended purpose could have been achieved, the prior art does not consider thinning of the material. Also note that, in the capping process, the prior art does not consider about the fact that the neck portion is locally deformed by the direct pressing of the skirt valley portion of the can by a hem bending roller. That is, in cases where the material used for the threaded metal can having the structure of Patent Document 1 is thinned, in the neck portion composed of the mouth portion and the shoulder portion, the strength (neck portion transverse rigidity) in a direction perpendicular to the container axis becomes insufficient. Therefore, during the capping process, there caused a problem that local deformation occurred at the neck portion.

The present invention has been made in view of the above-described problems, and aims to provide a threaded metal container capable of improving strength (neck portion transverse rigidity) in a direction perpendicular to a container axis at a neck portion composed of a mouth portion and a shoulder portion.

Means for Solving the Problems

A threaded metal container according to the present invention, includes:

a cylindrical body portion;

a shoulder portion formed from an upper portion of the body portion so as to incline with respect to a container axis and reduce in diameter upward; and a tubular mouth portion extending upward from an upper portion of the shoulder portion, wherein the mouth portion includes a base portion smoothly connected to an upper end of the shoulder portion, a skirt valley portion connected to the base portion, a skirt portion connecting to the skirt valley portion, and a threaded portion connected to the skirt portion, wherein the base portion includes a protruding portion protruding radially outward and having a diameter gradually increasing downward from the skirt valley portion and a bead portion radially inwardly protruding and smoothly curving downward from the protruding portion, the bead portion circumferentially extending in a linear or dotted pattern, and wherein a distance (bead height) between an outer surface of the protruding portion furthest away from the container axis and an outer surface of the bead portion closest to the container axis in a direction perpendicular to the container axis is 0.1 to 0.6 mm In this threaded metal container, it is preferable that a radius of curvature of a curved line forming the bead portion be 0.5 to 2.5 mm. In this threaded metal container, it is further preferable that the protruding portion be smoothly connected to the bead portion in a curved manner, and a radius of curvature of a curved line forming the protruding portion be 2.0 to 5.0 mm Furthermore, in this threaded metal container, it is effective when a (mouth diameter/body diameter) ratio which is a ratio of an outer diameter of the mouth portion to an outer diameter of the body portion is 0.5 or more.

Effects of the Invention

According to the present invention, since a bead portion in which a bead height is 0.1 to 0.6 mm is formed above the upper end of the shoulder portion, i.e., at the base portion positioned at the lower end of the mouth portion, the transverse rigidity of the neck portion composed of the mouth portion and the shoulder portion can be improved. Therefore, even if a load is applied to the mouth portion of the metal container in a transverse direction (direction perpendicular to the container axis) during the capping process, the transverse rigidity of this neck portion is high, which prevents local deformation. In addition, since the problem of insufficient transverse rigidity of the neck portion caused by thinning the material thickness of the container can be solved, it is possible to reduce the weight of the container by reducing the thickness of the material (wall thickness of the container).

When the radius of curvature of the curved line forming the bead portion is formed to 0.5 to 2.5 mm, or when the radius of curvature of the curved line forming the bead portion is formed to 0.5 to 2.5 mm and the radius of curvature of the curved line forming the protruding portion is formed to 2.0 to 5.0 mm, it is possible to improve the transverse rigidity of the neck portion without changing the size of the container in the axial direction, such as, e.g., the total height.

When the (mouth diameter/body diameter) ratio which is a ratio of the outer diameter of the mouth portion to the outer diameter of the body portion is 0.5 or more, the transverse rigidity of the neck portion can be effectively improved.

BRIEF DESCRIPTION OF THE DRAWINGS

FIG. 5A shows a neck portion strength evaluation test and FIG. 5B shows an axial strength evaluation test.

EMBODIMENT FOR CARRYING OUT THE INVENTION

Figure 1:
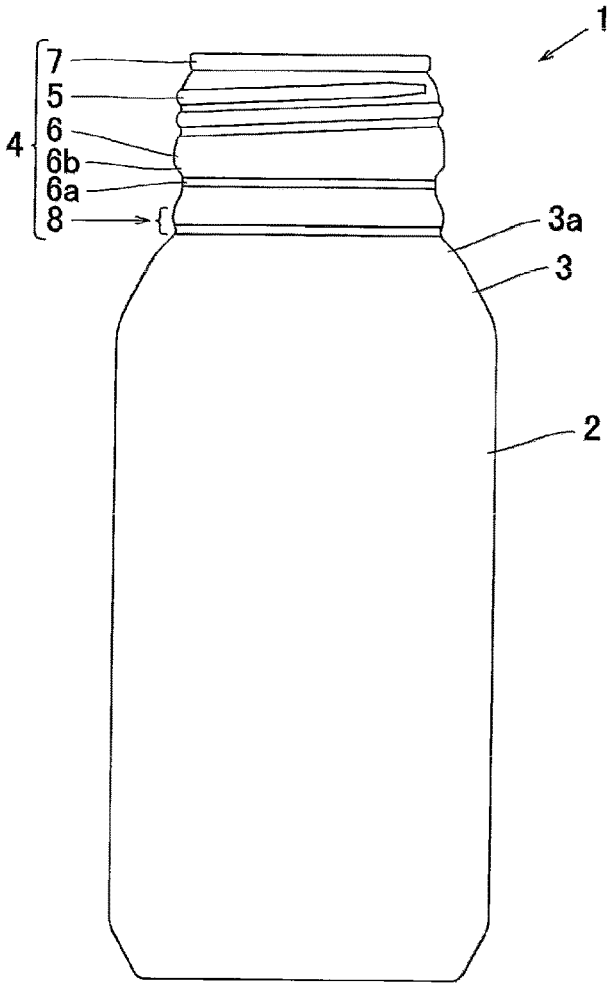
FIG. 1 is a front view showing an entire threaded metal can according to an embodiment of the present invention.
Figure 2:
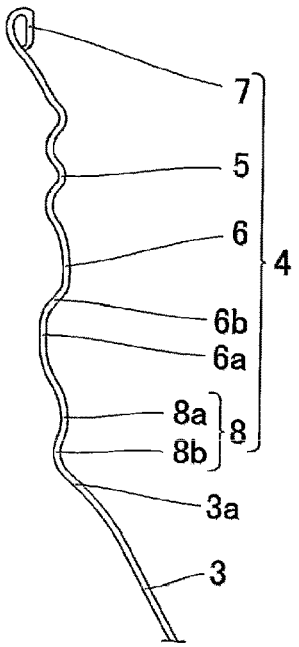
FIG. 2 is a longitudinal cross-sectional view enlarging the vicinity of the mouth portion of the metal can shown in FIG. 1.

Hereinafter, an embodiment of the present invention will be described in detail with reference to the attached figures. FIG. 1 is a front view showing the entire threaded metal can according to an embodiment of the present invention, and FIG. 2 is a view showing the vicinity of the mouth portion. As shown in FIG. 1, in the case of the threaded metal can 1 of this embodiment, a bottomed cylindrical body is formed by a method in which, for example, an aluminum plate is subjected to a drawing process or a drawing and ironing process or an aluminum slag is subjected to an impact process. Then, an opening end side portion of the cylindrical body is subjected to a diameter reduction process to thereby form a shoulder portion 3 inwardly inclined with respect to the container axis, a cylindrical mouth portion 4 at the portion above the upper end 3*a* of the shoulder portion 3, and a cylindrical body portion 2 below the shoulder portion 3. Then, a threaded portion 5, a skirt portion 6, and a skirt valley portion 6*a* smaller in diameter than the skirt portion are formed on the mouth portion 4, and a curled portion 7 is formed at the upper end of the mouth portion 4 to thereby produce a threaded metal can. Such a can is called a two-piece can, but may be a three-piece can. In the case of a three-piece can (not shown), the bottom portion side of a cylindrical body is reduced in diameter to thereby form a shoulder portion 3, a bottomed mouth portion 4, and a cylindrical body portion 2 on the opening portion side of the cylindrical body. Then, the upper end of the bottomed mouth portion 4 is cut to open. A threaded portion 5, a skirt portion 6, and a skirt valley portion 6*a* smaller in diameter than the skirt portion are formed on the mouth portion 4. The upper end of the mouth portion 4 is formed into a curled portion 7. Further, a bottom cover (not shown) is joined to the lower end opening portion of the body portion 2. Thus, a threaded metal can is produced. Note that a base portion 8 larger in diameter than the skirt valley portion 6*a* is formed below the skirt valley portion 6*a* of these two-piece can and three-piece can. The region from the base portion 8 to the curled portion 7 of the upper end forms the mouth portion 4, and the base portion 8 is connected to the upper end 3*a* of the shoulder portion 3.

Figure 9:
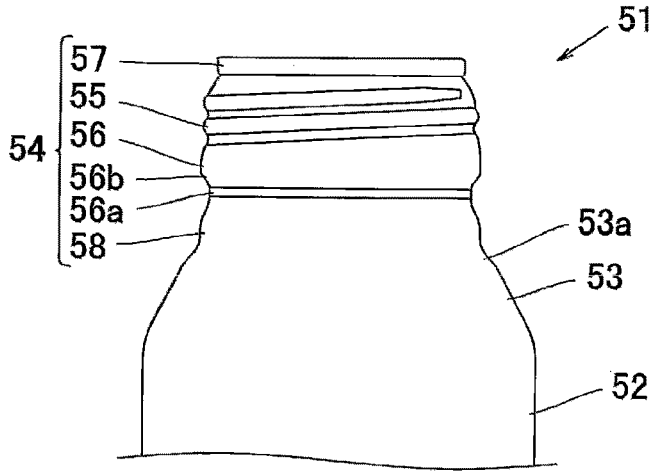
FIG. 9 is a partial front view showing a conventional threaded metal can.

After contents are filled in such a threaded metal can 1, the mouth portion 4 is sealed with a metal cap 60 by the similar capping process as shown in FIG. 9. That is, a cylindrical cap 60 is put on the mouth portion 4 and a load is applied to the can 1 in the axial direction with the pressure block 61. Then, in a state in which the contents are sealed with the cap 60 to which this axial load is being applied, from the side of the cap 60, a thread forming roller 62 is pressed along the threaded portion 5 of the can 1, and a hem bending roller 63 is pressed along the area from the skirt portion 6 to the skirt valley portion 6*a* of the can 1. With this, on the side wall of the cap 60, a female threaded portion 60*a* is formed, and at the lower end of the side wall, a fastened portion 60*b* is formed along the step 6*b* between the skirt portion 6 and the skirt valley portion 6*a*. This sealed state of the contents is maintained until the cap 60 is unscrewed and opened.

Figure 3:
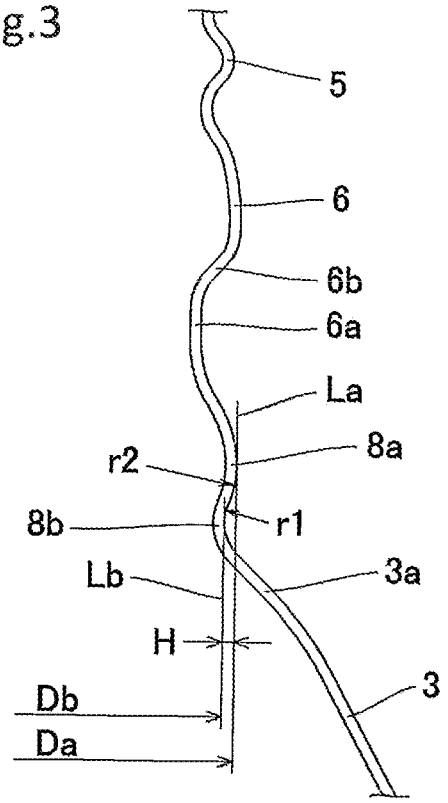
FIG. 3 is a partially enlarged view of FIG. 2 and shows a bead height.

In this embodiment, as shown in FIG. 2 and FIG. 3, between the skirt valley portion 6*a* and the upper end 3*a* of the shoulder portion 3, i.e., at the base portion 8 located at the lowest end of the mouth portion 4, a protruding portion 8*a* which radially outwardly protrudes and gradually expands in diameter downward from the skirt valley portion 6*a* and a bead portion 8*b* which radially inwardly protrudes and smoothly curves downward from the protruding portion 8*a* are formed over the entire circumference. The inventors of the present invention found the fact that when the bead height H of the bead portion 8*b* is set within the range of 0.1 to 0.6 mm, preferably within the range of 0.2 to 0.4 mm, the transverse rigidity of the neck portion composed of the mouth portion 4 and the shoulder portion 3 is improved. Here, as shown in FIG. 3, the bead height H denotes a distance between two lines La and Lb parallel to the container axis in a direction perpendicular to the container axis. The line La is a line parallel to the container axis and passing through the outer surface of the protruding portion 8*a* furthest away from the container axis, and the line Lb is a line parallel to the container axis and passing through the outer surface of the bead portion 8*b* closest to the container axis. The above-described distance is defined as the bead height H. In other words, assuming that the maximum outer diameter of the protruding portion 8*a* is Da and the minimum outer diameter of the bead portion 8*b* is Db, the bead height H is H=(Da−Db)/2.

As described above, the bead portion 8*b* formed at the base portion 8 of the mouth portion 4 may be formed such that the radius of curvature r1 of the curved line (line Lb) passing through the bottom portion of the bead portion 8*b* is set to 0.5 to 2.5 mm. Also, the protruding portion 8*a* located above the bead portion 8*b* may be smoothly bent adjacent to the bead portion 8*b*. In that case, the radius of curvature r2 of the curved line (line La) passing through the top of the protruding portion 8*a* may be formed to 2.0 to 5.0 mm. When the curved line of the bead portion 8*b* has the radius of curvature r1 falling with the above-described range, or when the curved line of the bead portion 8*b* has the radius of curvature r1 falling within the above-described range and the curved line of the protruding portion 8*a* has the radius of curvature r2 falling within the above-described range, it is possible to form the bead portion 8*b* and the protruding portion 8*a* in a limited height range. Therefore, it is possible to improve the transverse rigidity of the neck portion composed of the mouth portion 4 and the shoulder portion 3 without changing the dimensions of the can in the container axis direction (e.g., the total height, the mouth portion height, etc.).

Figure 10:
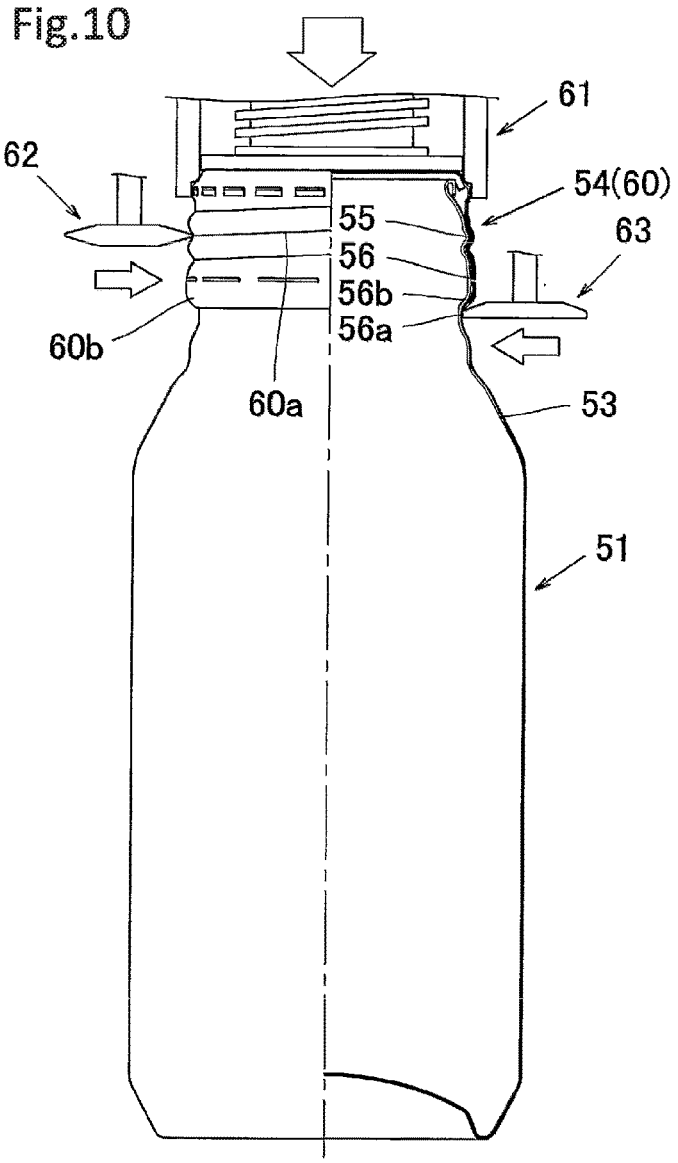
FIG. 10 is a view showing a conventional load applied situation at the time of capping.

Furthermore, in cases where the outer diameter of the mouth portion 4 is 30 mm or more, especially 35 mm or more, and the (mouth diameter/body diameter) ratio of the outer diameter of the mouth portion 4 to the outer diameter of the body portion 2 is 0.5 or more, particularly 0.6 or more, in other words, in cases where the can has a wide mouth portion, local deformation is likely to occur in the neck portion composed of the mouth portion 4 and the shoulder portion 3. For this reason, the present invention is effective for such a can having a wide mouth portion. Note that in the present invention, the outer diameter of the mouth portion 4 refers to the outer diameter of the screw thread of the threaded portion 5. For example, in cases where the outer diameter of the body portion 2 is 53 mm and the screw thread outer diameter of the threaded portion 5, i.e., the outer diameter of the mouth portion 4, is 37 mm, the (mouth diameter/body diameter) ratio becomes 0.70. Further, the cap for sealing the mouth portion (reference numeral 60 in FIG. 10) is 38 mm in the outer diameter.

Figure 4A:
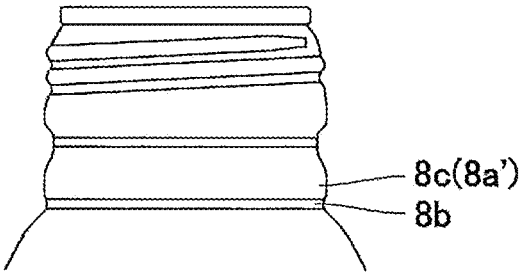
FIGS. 4A, 4B and 4C illustrate modified examples of a base portion having a bead portion.
Figure 4B:
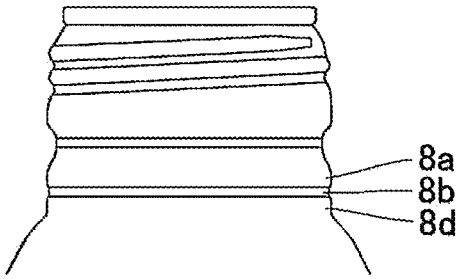
Figure 4C:
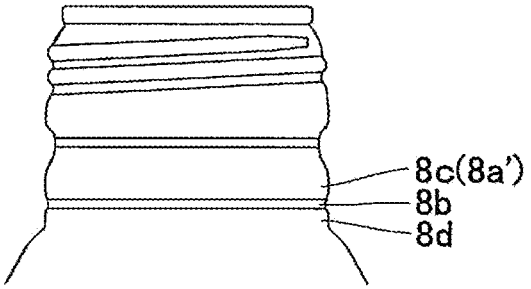

Returning to FIG. 1 to FIG. 3, the base portion 8 is formed such that the protruding portion 8*a* and the bead portion 8*b* are formed in a shape in which they are adjacent to each other and smoothly connected, but may be formed in the shapes shown in FIGS. 4A, 4B, and 4C. That is, as shown in FIG. 4A, the protruding portion may be a protruding portion 8*a*' having a linear portion 8*c* parallel to the container axis. Further, as shown in FIG. 4B, a linear portion 8*d* parallel to the container axis may be provided between the bead portion 8*b* and the upper end 3*a* of the shoulder portion 3. As shown in FIG. 4C, a protruding portion 8*a*' and a linear portion 8*d* may be provided.

Next, the functions and effects of the present embodiment will be described. In this embodiment, the height H of the bead portion 8*b* formed at the base portion 8 of the mouth portion 4 is 0.1 to 0.6 mm, preferably 0.2 to 0.4 mm Such a bead portion 8*b* is formed at the base portion 8 of the mouth portion 4 located at the upper end 3*a* of the shoulder portion 3. Therefore, in the capping process, even if a load is applied to the neck portion in a direction perpendicular to the container axis, it is possible to prevent occurrence of local deformation at the neck portion composed of the mouth portion 4 and the shoulder portion 3.

Hereinafter, tests for confirming the effects of the present invention will be described.

[Test 1]

Figure 5A:
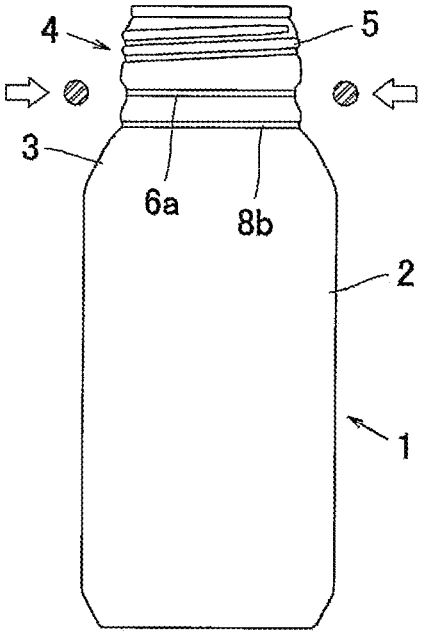
FIGS. 5A and 5B are schematic views showing a test method for evaluating strength of a metal can, where
Figure 5B:
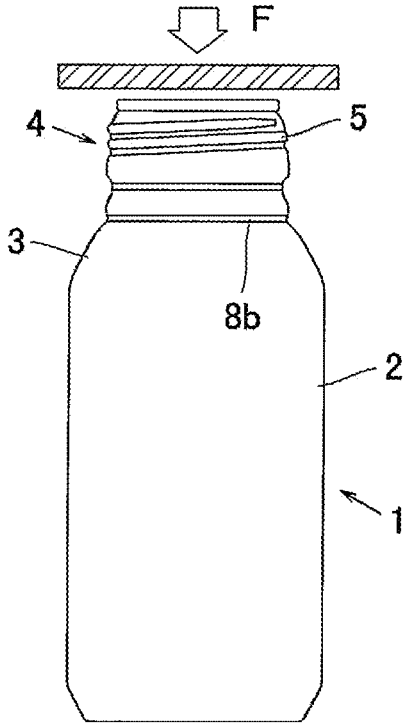

In order to verify the strength change of the can by the bead portion 8*b*, tests were carried out by the methods shown in FIGS. 5A and 5B. FIG. 5A is a schematic view showing a neck portion strength evaluation test. A load (see the arrow in the figure) toward the radial center of the can is applied to the skirt valley portion 6*a* of the mouth portion 4 by a compression jig indicated by a circle, and the transverse rigidity (stiffness in the radial direction) of the neck portion composed of the mouth portion 4 and the shoulder portion 3 is measured. FIG. 5B is a schematic diagram showing an axial strength evaluation test, and a load is applied in the container axis direction (the direction of the arrow) by a compression jig indicated by a square shape and the axial strength is measured.

Figure 6:
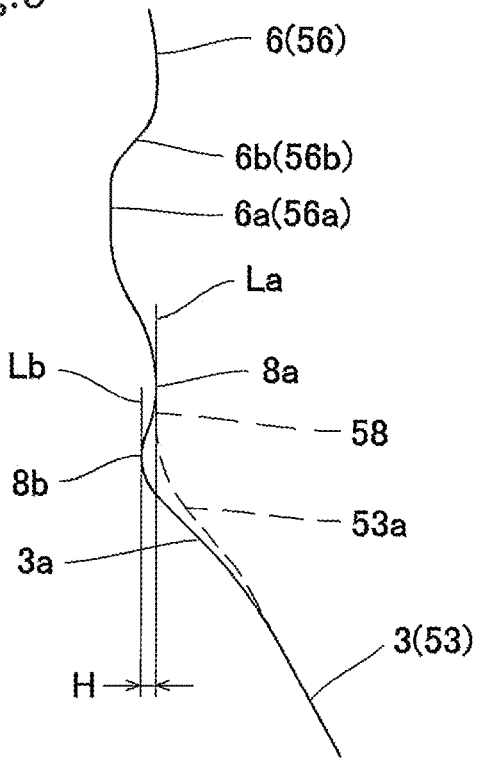
FIG. 6 is an enlarged view of the vicinity of a bead portion of a test can, where the solid line shows a can of this embodiment and the broken line shows a conventional can.

A test can was used in which the total height of the can 1 was 130 mm, the outer diameter of body portion 2 was 53 mm, the outer diameter of the mouth portion 4 (the outer diameter of the threaded portion 5) was 37 mm, the thickness of the body portion 2 was 0.20 mm, and the thickness of the threaded portion 5 was 0.33 mm FIG. 6 is an enlarged view of the vicinity of the bead portion of the test can. The solid line portion shows a can according to this embodiment. On the other hand, the broken line portion shows a conventional can, and its shape from the base portion 58 located at the lower end of the mouth portion to the upper end 53*a* of the shoulder portion 3 is different from that of the can according to this embodiment. Note that FIG. 6 shows that the bead height H of the conventional can is 0 mm and that the bead height H of the can according to this embodiment exceeds 0 mm Using the conventional can and the can of this embodiment as test cans, the neck portion transverse rigidity and the axial strength were measured by the methods shown in FIG. 5A and FIG. 5B. The results are shown in FIG. 7.

Figure 7:
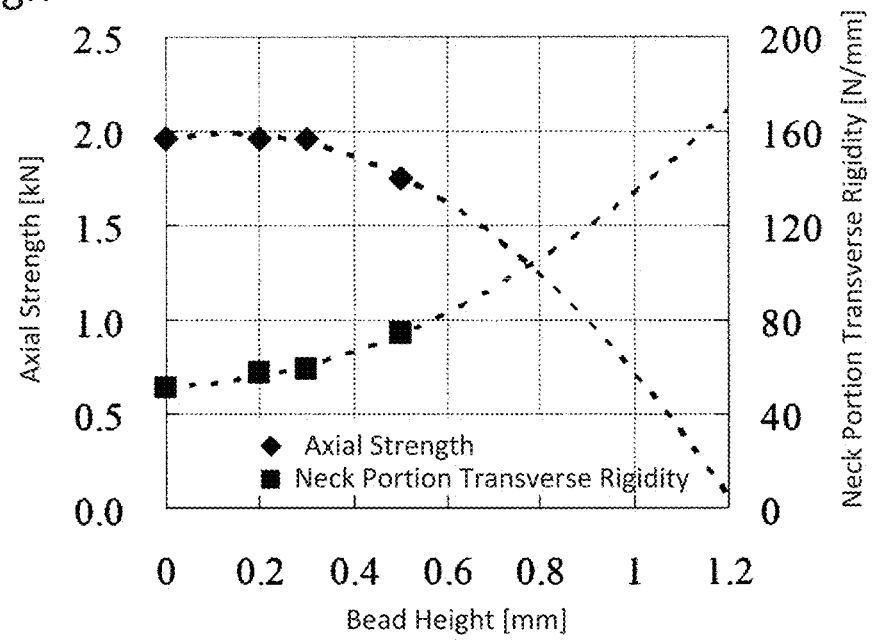
FIG. 7 is a graph showing experimental results and analysis results between the axial strength/the neck portion transverse rigidity and the bead height.

In FIG. 7, the mark "■" and the mark "◆" indicate the measurement results of the test cans formed to have the bead height of 0 mm, 0.2 mm, 0.3 mm, and 0.5 mm, and the measurement results of the neck portion transverse rigidity are indicated by the mark "■" and the measurement results of the axial strength are indicated by the mark "◆". Further note that the broken lines in FIG. 7 show the analysis results of the axial strength and the neck portion transverse rigidity under the above-described conditions. As shown by the broken lines, as the bead height increases, the neck portion transverse rigidity increases, while the axial strength is likely to decrease. By the way, it is considered that it is preferable that the axial strength be 1.6 kN or more and the neck portion transverse rigidity be 47 N/mm or more in order to secure the soundness at the time of capping. In FIG. 7, when the bead height is set to 0.6 mm, its axial strength decreases to a value close to 1.6 kN, which is considered to be preferable under the capping condition. Also, when the bead height exceeds 0.6 mm, the strength at the bead portion in the container axis direction decreases and buckling is likely to occur at the bead portion. For this reason, the bead height is preferably set so as to fall within the range of 0.1 to 0.6 mm. It is more preferred that the bead height be set so as to fall within the range of 0.2 to 0.4 mm. In this range, the neck portion transverse rigidity can be increased without remarkably lowering the axial strength.

[Test 2]

Then, tests were carried out on the thinning of the material (weight saving of the can). The results are shown in Table 1. Note that No. 3 (reference can) in Table 1 is a can using a non-thinned material (aluminum alloy plate with a thickness of 0.435 mm) and the bead height H shown by the broken line in FIG. 6 is set to 0 mm. As a thinned material obtained by thinning the material of the No. 3 (reference can), in a can having a bead height of 0 mm, a material (an aluminum alloy plate having a thickness of 0.385 mm) having an axial strength of about 1.6 kN was prepared. Using this thinned material, No. 1 (a conventional can in which a bead height is set to 0 mm) and No. 2 (a can of this embodiment in which a bead height is set to 0.2 mm) were produced. Note that in these No. 1 can to No. 3 can, the basic specifications on the overall height of the can 1, the outer diameter of the body portion 2, and the outer diameter of the threaded portion 5 were made to approximately the same size as the test can used in the above-described Test 1, that is, the total height of the can 1 was set to 130 mm, the outer diameter of the body portion 2 was set to 53 mm, and the outer diameter of mouth portion 4 (outer diameter of the threaded portion 5) was set to 37 mm. As for the wall thickness of the body portion 2, the No. 1 can and the No. 2 can were each set to 0.17 mm, the No. 3 can was set to 0.20 mm. As for the wall thickness of the threaded portion 5, the No. 1 can and the No. 2 can were each set to 0.32 mm, and the No. 3 can was set to 0.35 mm

TABLE 1

| Test can No. | Material thickness [mm] | Can weight [g] | Bead height [mm] | Axis strength [N] | Neck portion transverse rigidity [N/mm] |
|---|---|---|---|---|---|
| No. 1 (Conventional can) | 0.385 | 15.2 | 0 | 1,576 | 39.2 |
| No. 2 (Embodiment can) | 0.385 | 15.2 | 0.2 | 1,541 | 49.8 |
| No. 3 (Reference can) | 0.435 | 17.2 | 0 | 2,045 | 52.1 |

As shown in Table 1, it was verified that in the can (No. 2) of this embodiment in which the bead height was 0.2 mm, the neck portion transverse rigidity greatly was improved to 47 N/mm or more, which is said to be preferable, while maintaining the similar axial strength as that of the conventional can (No. 1) with a bead height of 0 mm. Further, the can (No. 2) according to the embodiment shows that strength close to the axial strength (1.6 kN or more) and the neck portion transverse rigidity (47 N/mm or more) which is considered to be preferable under capping conditions can be obtained while achieving about 12% weight reduction in the can weight. In summary, with this test, it was verified that the bead portion contributes to the material thinning (weight reduction of the can).

Figure 8A:
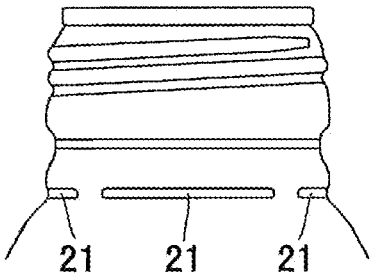
FIGS. 8A, 8B, and 8C show modified examples of a bead portion.
Figure 8B:
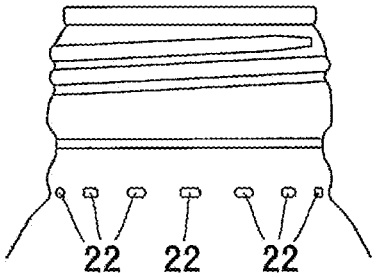
Figure 8C:
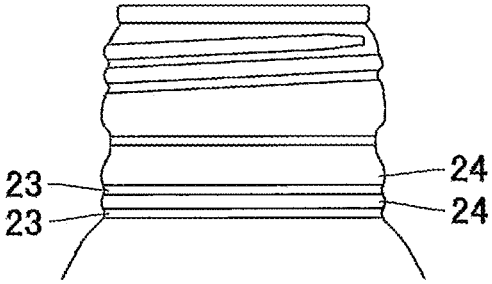

Although some embodiments of the present invention have been described above, it is needless to say that the present invention is not limited to the above-described embodiments and various modifications can be adopted. For example, the bead portion 9*b* shown in FIG. 1 to FIG. 4C can be formed in various shapes as shown in FIGS. 8A, 8B, and 8C. FIG. 8A shows a plurality of linear bead portions 21. FIG. 8B shows a plurality of dotted bead portions 22. These bead portions 21 and 22 may be provided at equal intervals at the base portion 9 of the mouth portion 4 with a space in the circumferential direction. In FIG. 8C, two or more bead portions 23 and protruding portions 24 are formed at different height positions in the container axis direction. In both the cases, the same effects as those of FIG. 1 to FIG. 4C can be obtained.

DESCRIPTION OF REFERENCE SYMBOLS

1, 51: threaded metal can
2, 52: body portion
3, 53: shoulder portion
3*a*, 53*a*: shoulder portion upper end
4, 54: mouth portion
5, 55: threaded portion
6, 56: skirt portion
6*a*, 56*a*: skirt valley portion

6*b*, 56*b*: step
7, 57 curled portion
8, 58 base portion
8*a*, 8*a*', 24: protruding portion
8*b*, 21, 22, 23: bead portion
8*c*: linear portion
60: cap
60*a*: female threaded portion
60*b*: fastened portion
61: pressure block
62: thread forming roller
63: hem bending roller

The invention claimed is:

1. A threaded metal container, comprising:

a cylindrical body portion;

a shoulder portion formed from an upper portion of the body portion so as to incline with respect to a container axis and reduce in diameter upward; and a tubular mouth portion extending upward from an upper portion of the shoulder portion, wherein the mouth portion includes a base portion smoothly connected to an upper end of the shoulder portion, a skirt valley portion connected to the base portion, a skirt portion connecting to the skirt valley portion, and a threaded portion connected to the skirt portion, wherein the base portion includes a protruding portion protruding radially outward and having a diameter gradually increasing downward from the skirt valley portion and a bead portion radially inwardly protruding and smoothly curving downward from the protruding portion, the bead portion circumferentially extending in a linear or dotted pattern, and wherein a bead height distance is a distance between a line parallel to a container axis and passing through an outer surface of the protruding portion furthest away from the container axis and a line parallel to the container axis and passing through an outer surface of the bead portion closest to the container axis, in a direction perpendicular to the container axis, is 0.1 to 0.6 mm.

2. A threaded metal container as recited in claim 1, wherein a radius of curvature of a curved line forming the bead portion is 0.5 to 2.5 mm.

3. The threaded metal container as recited in claim 2, wherein the protruding portion is smoothly connected to the bead portion in a curved manner, and wherein a radius of curvature of a curved line forming the protruding portion is 2.0 to 5.0 mm.

4. The threaded metal container as recited in claim 1, wherein a mouth diameter to body diameter ratio which is a ratio of an outer diameter of the mouth portion to an outer diameter of the body portion is 0.5 or more.

* * * * *